US010566718B1

(12) United States Patent
Smith, Jr. et al.

(10) Patent No.: US 10,566,718 B1
(45) Date of Patent: Feb. 18, 2020

(54) ELECTRICAL CONNECTOR HAVING CONFORMAL PIN ORGANIZER

(71) Applicant: TE CONNECTIVITY CORPORATION, Berwyn, PA (US)

(72) Inventors: Graham Harry Smith, Jr., Mechanicsburg, PA (US); Charles Raymond Gingrich, III, Mechanicsburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/383,826

(22) Filed: Apr. 15, 2019

(51) Int. Cl.

| | |
|---|---|
| ***H01R 12/00*** | (2006.01) |
| ***H01R 12/72*** | (2011.01) |
| ***H01R 13/436*** | (2006.01) |
| ***H01R 12/58*** | (2011.01) |
| *H01R 12/70* | (2011.01) |

(52) U.S. Cl.
CPC ..... *H01R 12/727* (2013.01); *H01R 12/585* (2013.01); *H01R 13/4367* (2013.01); *H01R 12/7005* (2013.01)

(58) Field of Classification Search
CPC ..... H01R 23/7073; H01R 9/091; H01R 13/4538; H01R 13/631
USPC ..... 439/79, 80, 140, 141
See application file for complete search history.

(56) References Cited

U.S. PATENT DOCUMENTS

| | | | | |
|---|---|---|---|---|
| 5,664,968 | A * | 9/1997 | Mickievicz | H01R 13/6587 439/607.1 |
| 8,123,560 | B2 * | 2/2012 | McAlonis | H01R 12/712 439/607.13 |
| 8,313,354 | B2 * | 11/2012 | McAlonis | H01R 12/722 439/198 |
| 2011/0294325 | A1 * | 12/2011 | McAlonis | H01R 12/722 439/198 |
| 2011/0294337 | A1 * | 12/2011 | McAlonis | H01R 12/722 439/378 |

* cited by examiner

*Primary Examiner* — Phuong Chi Thi Nguyen

(57) ABSTRACT

An electrical connector includes a housing having a mounting end mounted to a circuit board and contact channels receiving signal contacts. The signal contacts have mating ends and terminating ends. Each terminating end has a shoulder, a neck extending from the shoulder and a pin extending from the neck. The neck is narrower than the complaint pin and the shoulder. A conformal pin organizer is coupled to the mounting end of the housing. The conformal pin organizer has signal openings receiving the terminating ends and deflecting portions extending into the signal openings. The conformal pin organizer is positioned along the terminating ends such that the deflecting portions engage the necks of the corresponding terminating ends.

20 Claims, 7 Drawing Sheets

ELECTRICAL CONNECTOR HAVING CONFORMAL PIN ORGANIZER

BACKGROUND OF THE INVENTION

The subject matter herein relates generally to electrical connectors.

Electrical connectors are used within communication systems to electrically connect components, such as circuit boards. For example, electrical connectors may be used to connect a daughter card and a backplane. High speed electrical connectors typically include a housing holding a plurality of contacts. The contacts have compliant pins configured to be press-fit into the circuit board. The compliant pins have neck regions that are narrower and bulged regions that are wider. At the necked regions, the impedance is increased affecting the data transmission along the signal contact. Some known electrical connectors include pin organizers at the bottoms of the electrical connectors to hold the pins for mounting to the circuit board. The organizers are typically made from rigid plastic materials that slide over the compliant pins onto the bottom of the electrical connector as the electrical connector is mounted to the circuit board. The slot size for sliding over the compliant pin must accommodate the widest part of the compliant pin. However, when the organizer is seated against the electrical connector, the slots are aligned with the narrower region of the pin such that a significant amount of air is introduced around the pen at the interface between the circuit board and the bottom of the electrical connector. Signal integrity issues arise at the mounting area between differential pairs of signals due to the higher impedance introduced by the air around the pins in such region.

A need remains for an electrical connector having improved signal integrity at the mounting interface between the electrical connector and the circuit board.

BRIEF DESCRIPTION OF THE INVENTION

In one embodiment, an electrical connector is provided including a housing having contact channels and a mounting end configured to be mounted to a circuit board. Signal contacts are received in corresponding contact channels. The signal contacts have mating ends and terminating ends configured to be terminated to the circuit board. Each terminating end has a shoulder, a neck extending from the shoulder and a pin extending from the neck. The neck is narrower than the complaint pin and the shoulder. A conformal pin organizer is coupled to the mounting end of the housing. The conformal pin organizer has signal openings receiving terminating ends of corresponding signal contacts. The conformal pin organizer has deflecting portions extending into the signal openings. The conformal pin organizer is positioned along the terminating ends such that the deflecting portions engage the necks of the corresponding terminating ends.

In another embodiment, an electrical connector is provided including a housing having contact channels and a mounting end configured to be mounted to a circuit board. Signal contacts are received in corresponding contact channels. The signal contacts have mating ends. The signal contacts have terminating ends configured to be terminated to the circuit board. Each terminating end has a shoulder, a neck extending from the shoulder and a pin extending from the neck. The neck is narrower than the complaint pin and the shoulder. Ground contacts are received in corresponding contact channels. The ground contacts have mating ends and terminating ends configured to be terminated to the circuit board. Each terminating end has a pin. A conformal pin organizer is coupled to the mounting end of the housing. The conformal pin organizer has ground openings receiving terminating ends of corresponding ground contacts with the conformal pin organizer spaced apart from the terminating ends of the ground contacts such that air gaps are formed between the terminating ends of the ground contacts and the conformal pin organizer. The conformal pin organizer has signal openings receiving terminating ends of corresponding signal contacts. The conformal pin organizer has deflecting portions extending into the signal openings. The conformal pin organizer is positioned along the terminating ends of the signal contacts such that the deflecting portions engage the necks of the corresponding terminating ends.

In a further embodiment, an electrical connector assembly is provided including a circuit board having a mounting surface and having signal vias and ground vias. The electrical connector assembly includes an electrical connector mounted to the mounting surface. The electrical connector includes a housing having a mounting end mounted to the mounting surface of the circuit board. The housing has contact channels receiving signal contacts and ground contacts. The signal contacts have mating ends and terminating ends terminated to the circuit board. Each terminating end has a shoulder, a neck extending from the shoulder and a compliant pin extending from the neck. The compliant pin is press fit in the corresponding signal via of the circuit board. The neck is narrower than the complaint pin and the shoulder. The ground contacts have mating ends and terminating ends terminated to the circuit board. Each terminating end has a compliant pin press fit in the corresponding ground via of the circuit board. A conformal pin organizer is positioned between the mounting end of the housing and the mounting surface of the circuit board. The conformal pin organizer has ground openings receiving terminating ends of corresponding ground contacts. The conformal pin organizer has signal openings receiving terminating ends of corresponding signal contacts. The conformal pin organizer have deflecting portions extending into the signal openings. The conformal pin organizer is positioned along the terminating ends of the signal contacts such that the deflecting portions engage the necks of the corresponding terminating ends.

DETAILED DESCRIPTION OF THE INVENTION

Figure 1:
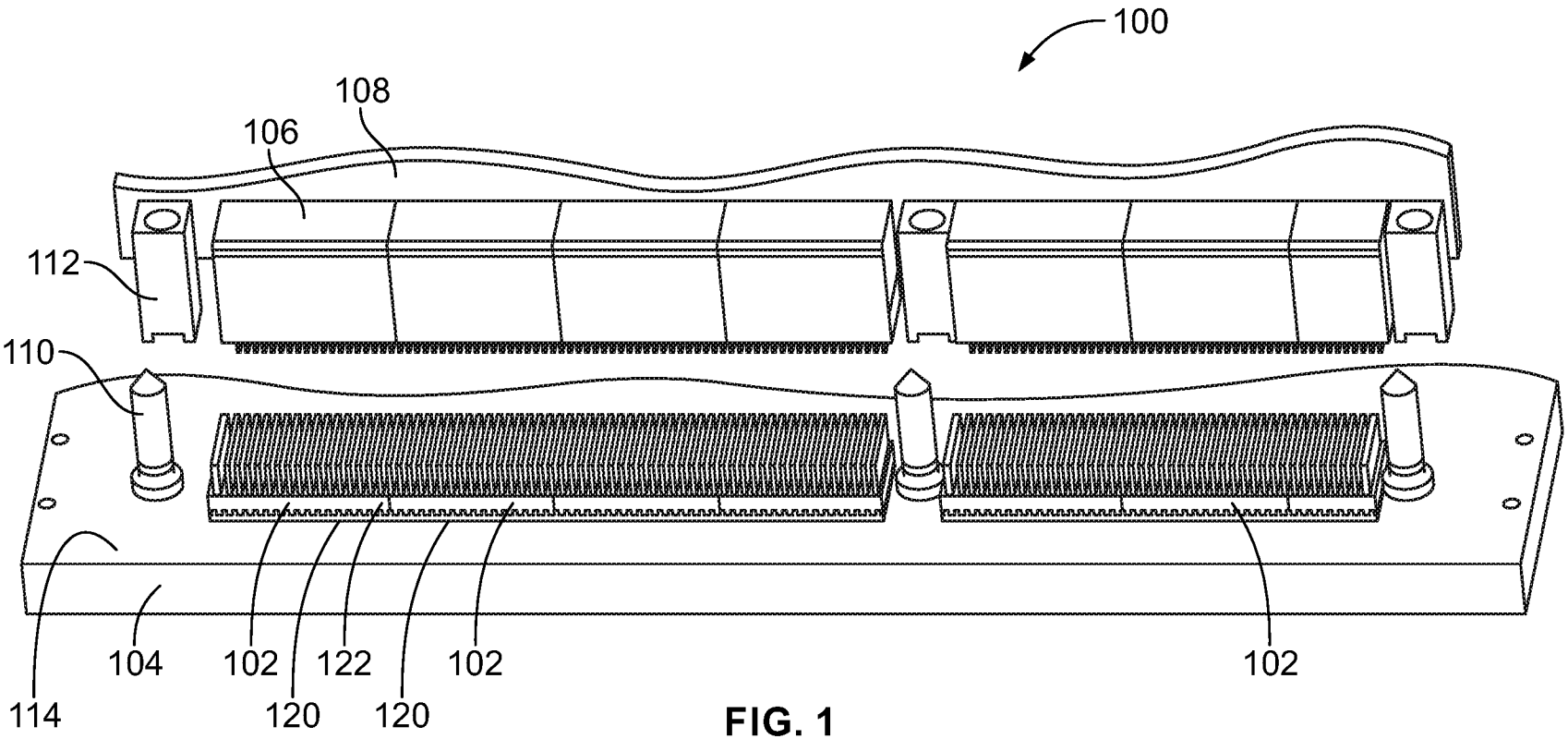
FIG. 1 is a perspective view of an electrical connector system in accordance with an exemplary embodiment.

FIG. 1 is a perspective view of an electrical connector system 100 in accordance with an exemplary embodiment. The electrical connector system 100 includes a plurality of electrical connectors 102 mounted to a circuit board 104, such as a backplane. The electrical connector system 100 includes a plurality of electrical connectors 106 mounted to a circuit board 108, such as a daughter card. In the illustrated embodiment, the guide pins 110 are mounted to the circuit board 104 and guide modules 112 are mounted to the circuit board 108 to guide mating of the daughter card assembly with the backplane assembly. The guide pins 110 and the guide modules 112 aligned with the electrical connectors 106 with the electrical connectors 102.

In an exemplary embodiment, the electrical connectors 102 are vertical electrical connectors having a mating interface and a mounting interface at opposite ends of each electrical connector 102, such as at a top and a bottom of each electrical connector 102. The mounting interfaces of the electrical connectors 102 are mounted to a mounting surface 114 of the circuit board 104. In an exemplary embodiment, the electrical connectors 106 are right angle electrical connectors having mating interfaces and mounting interfaces perpendicular to each other, such as at a bottom and a side of each electrical connector 106. As such, the circuit board 108 is oriented perpendicular to the circuit board 104. Other orientations are possible in alternative embodiments.

In an exemplary embodiment, the electrical connector 102 includes a conformal pin organizer 120 at the mounting interface between the electrical connector 102 and the circuit board 104. The conformal pin organizer 120 holds terminating ends of signal contacts and ground contacts of the electrical connector 102. The conformal pin organizer 120 is provided in the space between the circuit board 104 and a housing 122 of the electrical connector 102. The conformal pin organizer 120 provides impedance control for the signal contacts of the electrical connector 102. The conformal pin organizer 120 surrounds the signal contacts with dielectric material. In an exemplary embodiment, the conformal pin organizer 120 is a flexible material. The conformal pin organizer 120 may be compressed between the housing 122 and the circuit board 104 when the electrical connector 102 is mounted to the circuit board 104. The conformal pin organizer 120 may provide an environmental seal between the housing 122 and the circuit board 104. In an exemplary embodiment, the conformal pin organizer 120 is manufactured from an elastomer material. In various embodiments, the conformal pin organizer 120 may be manufactured from a rubber material, such as a silicone rubber material. Optionally, the electrical connector 106 may include a conformal pin organizer 120 at the mounting interface between the electrical connector 106 and the circuit board 108.

Figure 2:
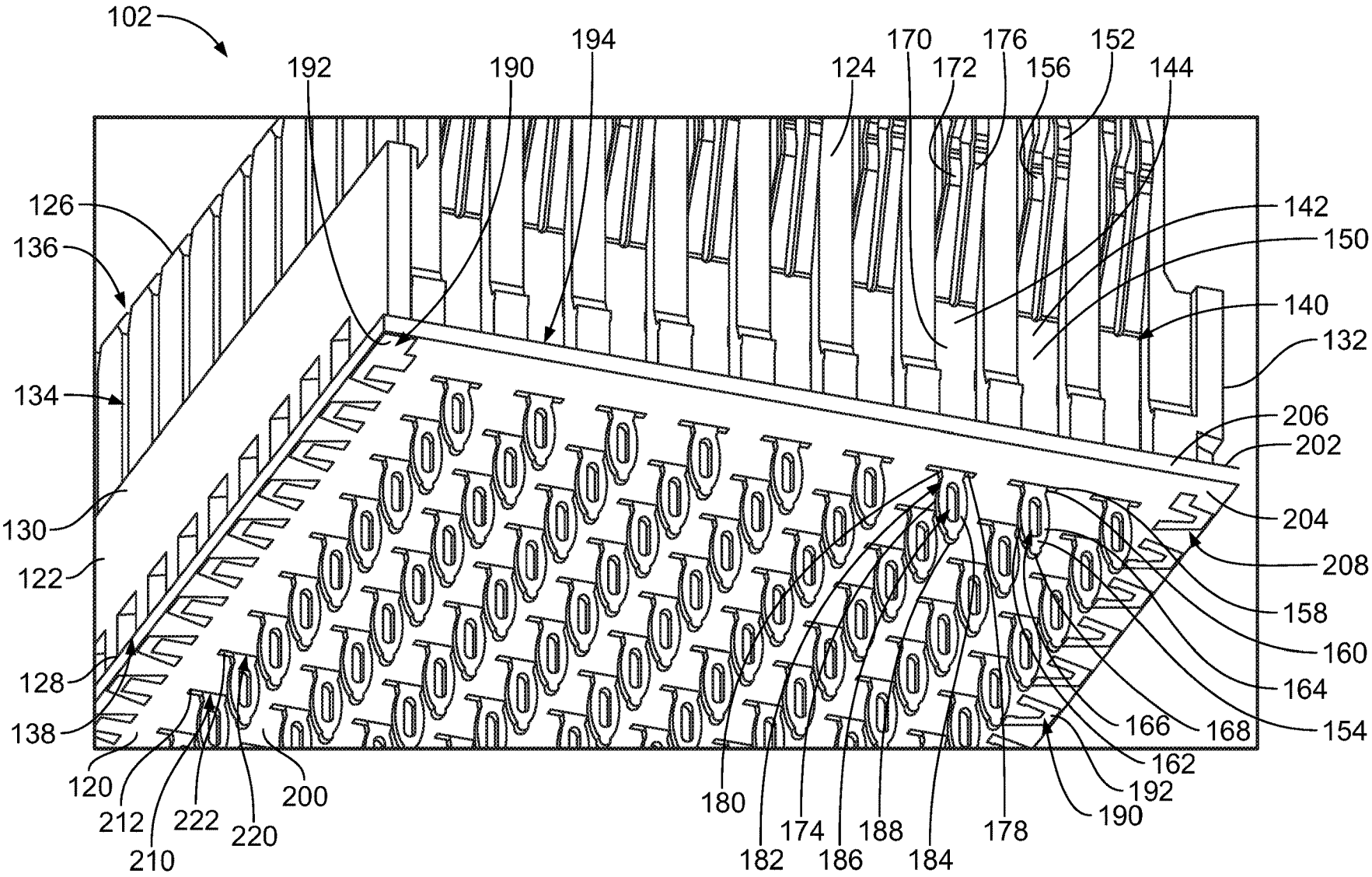
FIG. 2 is a bottom perspective view of a portion of an electrical connector of the electrical connector system in accordance with an exemplary embodiment.
Figure 3:
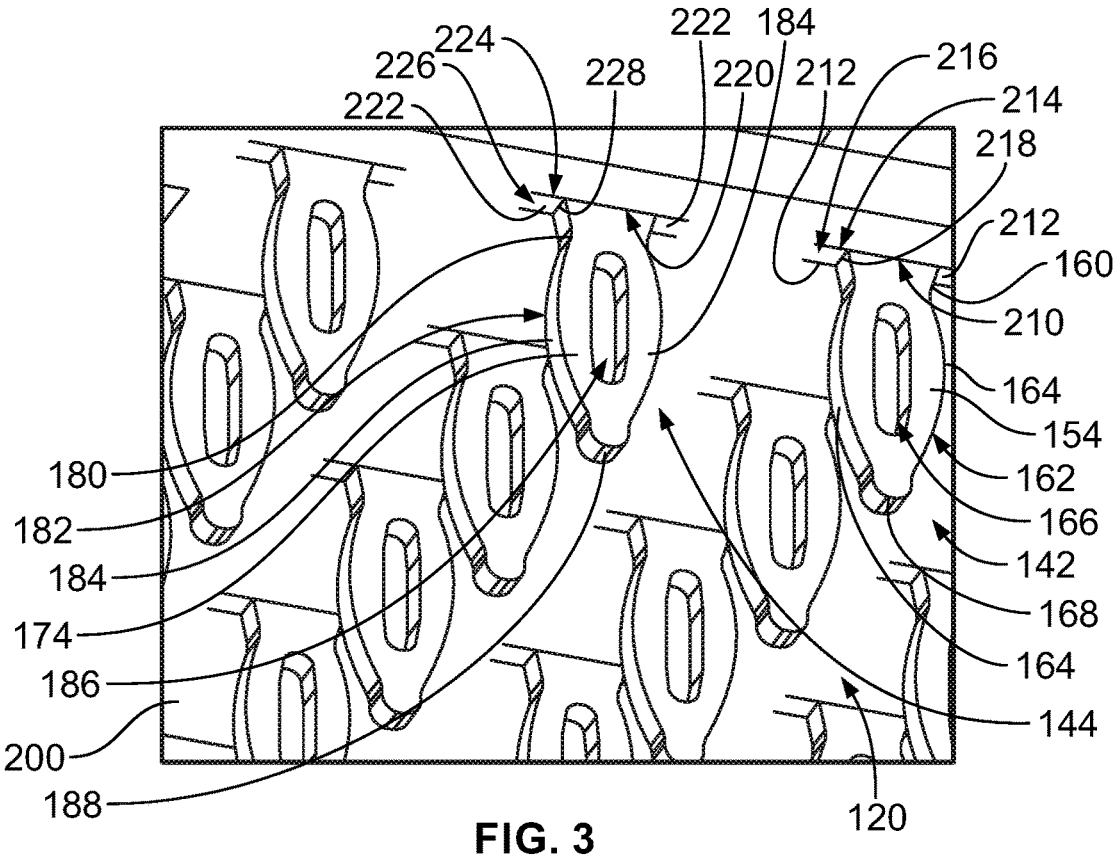
FIG. 3 is an enlarged, bottom perspective view of a portion of the electrical connector in accordance with an exemplary embodiment.

FIG. 2 is a bottom perspective view of a portion of the electrical connector 102 in accordance with an exemplary embodiment. FIG. 3 is an enlarged, bottom perspective view of a portion of the electrical connector 102 in accordance with an exemplary embodiment. The electrical connector 102 includes the housing 122 and the conformal pin organizer 120.

The housing 122 is manufactured from a dielectric material, such as a plastic material. The housing 122 may be manufactured from a dielectric material having a dielectric constant of between approximately 3.0 and 5.0. For example, the housing 122 may be manufactured from a material having a dielectric constant of approximately 3.5. The housing 122 has ends 124 extending between a top 126 and a bottom 128. The housing 122 has a first side 130 and a second side 132 opposite the first side 130. The housing 122 includes slots 134 open at the sides 130, 132. The slots 134 are open at the top 126, such as for receiving contacts of the electrical connector 106 (shown in FIG. 1). In the illustrated embodiment, the top 126 is a mating end 136 and the bottom 128 is a mounting end 138. The housing 122 includes contact channels 140 extending between the top 126 and the bottom 128.

In an exemplary embodiment, the electrical connector 102 includes signal contacts 142 and ground contacts 144. The signal contacts 142 are received in corresponding contact channels 140. The ground contacts 144 are received in corresponding contact channels 140. The housing 122 holds the signal and ground contacts 142, 144 for mating with the electrical connector 106 and for mounting to the circuit board 104. Optionally, the signal contacts 142 may be arranged in pairs. The ground contacts 144 may be interspersed between the signal contacts 142. In various embodiments, the ground contacts 144 may be arranged in pairs interspersed between the pairs of signal contacts 142.

Each signal contact 142 has a contact body 150 extending between a mating end 152 and a terminating end 154. In the illustrated embodiment, the signal contact 142 has spring beams 156 at the mating end 152. However, other types of mating ends may be provided in alternative embodiments, such as pins, sockets, blades, and the like. In an exemplary embodiment, the terminating end 154 includes a shoulder 158, a neck 160 extending from the shoulder 158, and a compliant pin 162 extending from the neck 160. The compliant pin 162 is configured to be press-fit into a plated via of the circuit board 104 (shown in FIG. 1). In the illustrated embodiment, the compliant pin 162 is an eye-of-the-needle pin. The compliant pin 162 includes a bulged sections 164 flanking an opening 166. The compliant pin 162 extends to a tip 168. The compliant pin 162 is widest along the bulged sections 164 and is narrower at the tip 168 and at the neck 160. In alternative embodiments, rather than having the compliant pin 162, the terminating end 154 may include a solder pin (for example, a solder tail) configured to be soldered to the circuit board 104. The solder pin may be surface mounted to the circuit board 104 or through-hole mounted to the circuit board 104. The signal contact 142 has increased impedance through the neck 160 because the neck 160 is narrower. In an exemplary embodiment, the conformal pin organizer 120 is aligned with and configured to engage the terminating end 154 at the neck 160 to lower the impedance of the data signals through the neck 160 by surrounding the neck 160 with dielectric material having a relatively high dielectric constant, as compared to air and/or compared to the dielectric material surrounding the other portions of the signal contact 142.

Each ground contact 144 has a contact body 170 extending between a mating end 172 and a terminating end 174. In the illustrated embodiment, the ground contact 144 has spring beams 176 at the mating end 172. However, other types of mating ends may be provided in alternative embodiments, such as pins, sockets, blades, and the like. In an exemplary embodiment, the terminating end 174 includes a shoulder 178, a neck 180 extending from the shoulder 178, and a compliant pin 182 extending from the neck 180. In the illustrated embodiment, the compliant pin 182 is an eye-of-the-needle pin. The compliant pin 182 includes a bulged sections 184 flanking an opening 186. The compliant pin 182 extends to a tip 188. The compliant pin 182 is widest along the bulged sections 184 and is narrower at the tip 188 and at the neck 180. The compliant pin 182 is configured to be press-fit into a plated via of the circuit board 104 (shown in FIG. 1). In alternative embodiments, rather than having the compliant pin 182, the terminating end 174 may include a solder pin (for example, a solder tail) configured to be soldered to the circuit board 104. The solder pin may be surface mounted to the circuit board 104 or through-hole mounted to the circuit board 104.

In an exemplary embodiment, the housing 122 includes mounting features 190 at the bottom 128 for mounting the housing 122 to the circuit board 104. The mounting features 190 have mounting surfaces 192 the mounting surfaces 192 are coplanar with each other and define a seating plane for resting the housing 122 on the circuit board 104. The mounting features 190 stand proud of the bottom 128 and form a pocket 194 that receives the conformal pin organizer 120.

The conformal pin organizer 120 includes a pad 200 extending between an upper surface 202 and a lower surface 204. The conformal pin organizer 120 includes edges 206 surrounding the pad 200. Optionally, the edges 206 may surround the perimeter of the housing 122. In an exemplary embodiment, the conformal pin organizer 120 includes cutouts 208 that receive mounting features 190. The pad 200 is manufactured from an elastomeric material, such as a rubber material. The pad 200 may be manufactured from a material having a dielectric constant of between approximately 3.0 and 6.0. In various embodiments, the pad 200 may be manufactured from a material having a dielectric constant approximately equal to the dielectric constant of the housing 122. In other various embodiments, the pad 200 may be manufactured from a material having a dielectric constant higher than the dielectric constant of the housing 122. In other various embodiments, the pad 200 may be manufactured from a material having a dielectric constant lower than the dielectric constant of the housing 122.

The conformal pin organizer 120 includes signal openings 210 receiving terminating ends 154 of corresponding signal contacts 142. In an exemplary embodiment, the conformal pin organizer 120 includes deflecting portions 212 extending into the signal openings 210. The deflecting portions 212 are configured to engage the terminating ends 154 of the signal contacts 142. In an exemplary embodiment, the deflecting portions 212 engage the neck 160 of the corresponding signal contact 142. The conformal pin organizer 120 fills the space around the neck 160 with dielectric material rather than air. As such, the transition for the signal contact 142 between the housing 122 and the circuit board 104 is through mediums having consistent dielectric constants (for example, selected along the different sections of the signal contact 142 to achieve a generally constant impedance along the signal path), rather than having abruptly changing dielectric constants, which would be the case if the signal contact 142 were to transition from the housing 122 to an air void prior to being received in the circuit board 104.

The deflecting portions 212 are configured to be deflected outward as the compliant pin 162 passes through the signal opening 210 and are configured to return inward to engage the neck 160 after the compliant pin 162 passes through the signal opening 210 when the conformal pin organizer 120 is positioned along the bottom 128 of the housing 122. The deflecting portions 212 deflect in such manner to allow the compliant pin 162 to pass through the signal opening 210 while allowing the conformal pin organizer 120 to surround and engage the neck 160 on all four sides of the signal contact 142. In various embodiments, the deflecting portions 212 may stretch or deform within the plane of the conformal pin organizer 120. In other various embodiments, the deflecting portions 212 may deflect out of the plane of the conformal pin organizer 120, such as by flexing downward as the compliant pin 162 passes through the signal opening 210, later returning into the plane of the conformal pin organizer 120 to engage the neck 160. For example, the deflecting portions 212 may be hinged and operate as flaps to allow the compliant pin 162 to pass through the signal opening 210.

In an exemplary embodiment, the conformal pin organizer 120 includes slits 214 in the pad 200 forming the deflecting portions 212. The slits 214 are open to the signal opening 210 forming the deflecting portions 212 between a fixed end 216 and a free end 218. The deflecting portion 210 is flexible at the fixed end 216 such that the free end 218 may be moved or rotated outward relative to the signal opening 210, such as when the compliant pin 162 passes through the signal opening 210. The deflecting portions 212 may be compressed toward the fixed end 216, such as with the free end 218 being pressed toward the fixed end 216.

In an exemplary embodiment, the conformal pin organizer 120 includes ground openings 220 receiving terminating ends 174 of corresponding ground contacts 144. In various embodiments, the conformal pin organizer 120 includes deflecting portions 222 extending into the ground openings 220. The deflecting portions 222 are configured to engage the terminating ends 174 of the ground contacts 144. In an exemplary embodiment, the deflecting portions 222 engage the neck 180 of the corresponding ground contact 144. However, in other various embodiments, the ground openings 220 may be devoid of deflecting portions 222 and may be oversized relative to the ground contacts 144 such that the conformal pin organizer 120 is spaced apart from the ground contacts 144 such that an air gap is formed between the conformal pin organizer 120 and the ground contacts 144.

In an exemplary embodiment, the conformal pin organizer 120 includes slits 224 in the pad 200 forming the deflecting portions 222. The slits 224 are open to the ground opening 220 forming the deflecting portions 222 between a fixed end 226 and a free end 228. The deflecting portion 220 is flexible at the fixed end 226 such that the free end 228 may be moved or rotated outward relative to the ground opening 220, such as when the compliant pin 182 passes through the ground opening 220. The deflecting portions 222 may be compressed toward the fixed end 226, such as with the free end 228 being pressed toward the fixed end 226.

Figure 4:
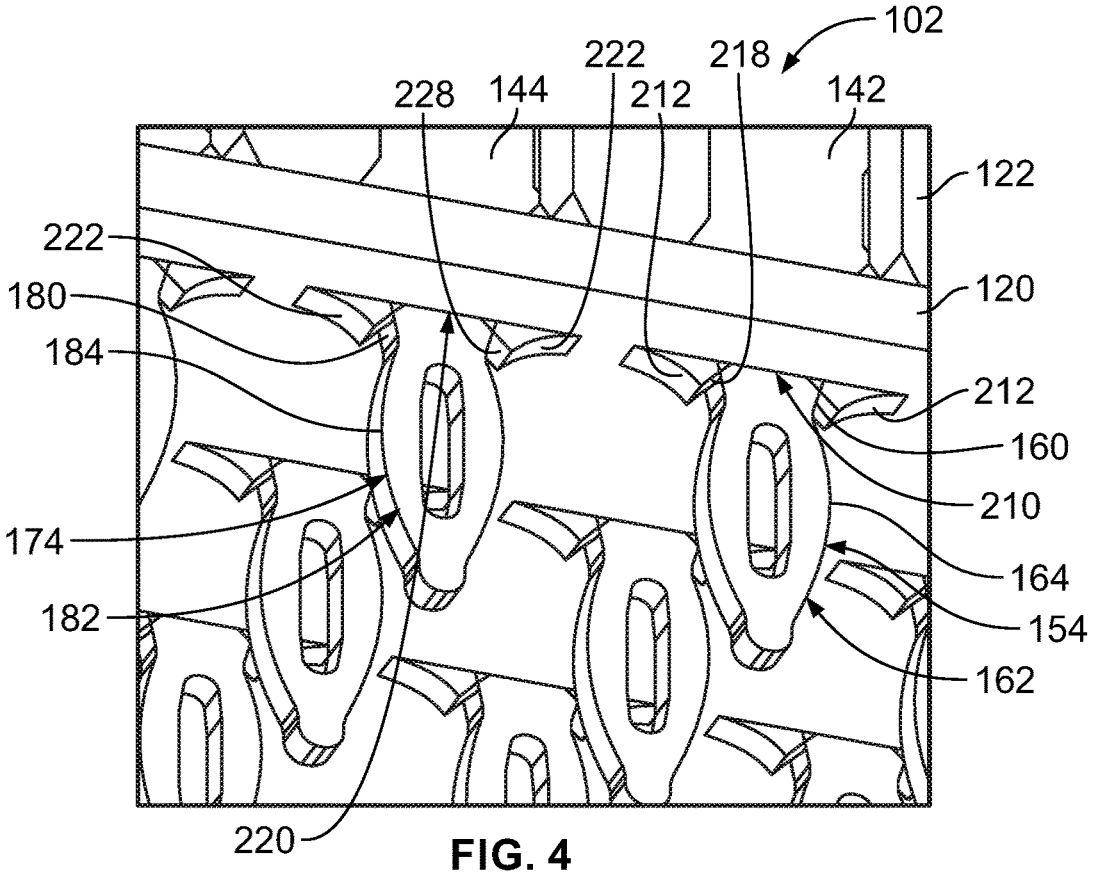
FIG. 4 is a bottom perspective view of a portion of the electrical connector in accordance with an exemplary embodiment.

FIG. 4 is a bottom perspective view of a portion of the electrical connector 102 in accordance with an exemplary embodiment. FIG. 4 illustrates the conformal pin organizer 120 positioned on the housing 122. The terminating ends 154, 174 have been pressed through the conformal pin organizer 120. During assembly, the deflecting portions 212 may be rotated outward by the compliant pins 162, 182. For example, because the bulged sections 164, 184 are wider than the signal openings 210 and the ground openings 220, the deflecting portions 212 may be rotated outward as the compliant pins 162, 180 to pass through the signal openings 210 and the ground openings 220. While the free ends 218, 228 of the deflecting portions 212, 222 engage the necks 160, 180, air pockets may still be present around the signal contacts 142 and the ground contacts 144, such as in the areas vacated by the deflecting portions 212, 222. In an exemplary embodiment, the deflecting portions 212, 222 may be pressed inward to fill such air voids. For example, when the electrical connector 102 is mounted to the circuit board 104, the circuit board 104 may press against the deflecting portions 212, 222 to close the deflecting portions 212, 222.

Figure 5:
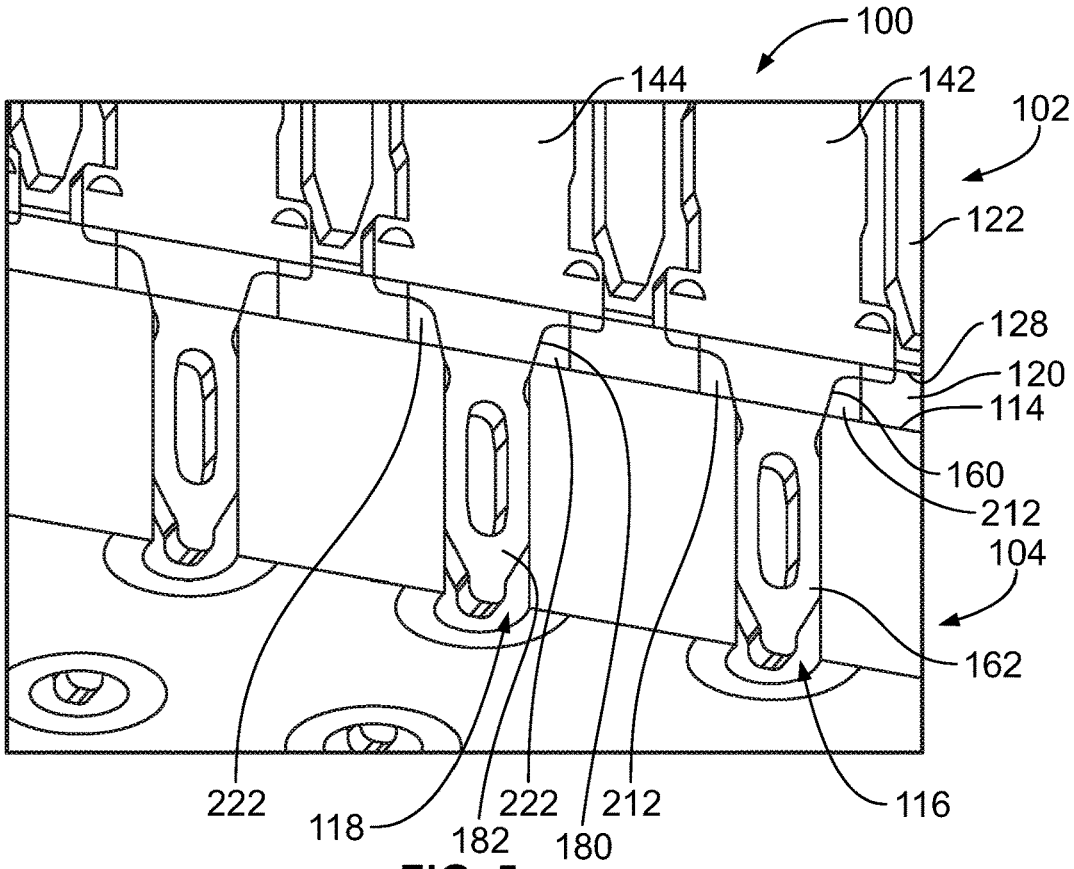
FIG. 5 is a cross-sectional view of a portion of the electrical connector system in accordance with an exemplary embodiment showing the electrical connector mounted to a circuit board.

FIG. 5 is a cross-sectional view of a portion of the electrical connector system 100 showing the electrical connector 102 mounted to the circuit board 104. The electrical connector 102 is mounted to the mounting surface 114 of the circuit board 104. The circuit board 104 includes signal vias 116 and ground vias 118 extending therethrough. The compliant pins 162 of the signal contacts 142 are received in corresponding signal vias 116. The compliant pins 182 of the ground contacts 144 are received in corresponding ground vias 118.

In an exemplary embodiment, when the electrical connector 102 is mounted to the circuit board 104, the conformal pin organizer 120 is compressed against the mounting surface 114. In an exemplary embodiment, the conformal pin organizer 120 is compressible in the mounting direction between the bottom 128 of the housing 122 and the mounting surface 114 of the circuit board 104. In an exemplary embodiment, as the electrical connector 102 is pressed onto the circuit board 104, the deflecting portions 212, 222 engage the mounting surface 114 and are closed into the conformal pin organizer 120. The deflecting portions 212, 222 engage the necks 160, 180 of the signal contacts 142 and the ground contacts 144. As such, the signal contacts 142 and the ground contacts 144 are surrounded by the dielectric material of the conformal pin organizer 120 in the space between the bottom 128 of the housing 122 and the mounting surface 114. The necks 160, 180 are not surrounded by air voids, but rather are surrounded by dielectric material having a dielectric constant that is closer to the dielectric constant of the housing 122 than the dielectric constant of air. As such, signal integrity through the transition from the circuit board 104 to the housing 122 is maintained.

Figure 6A:
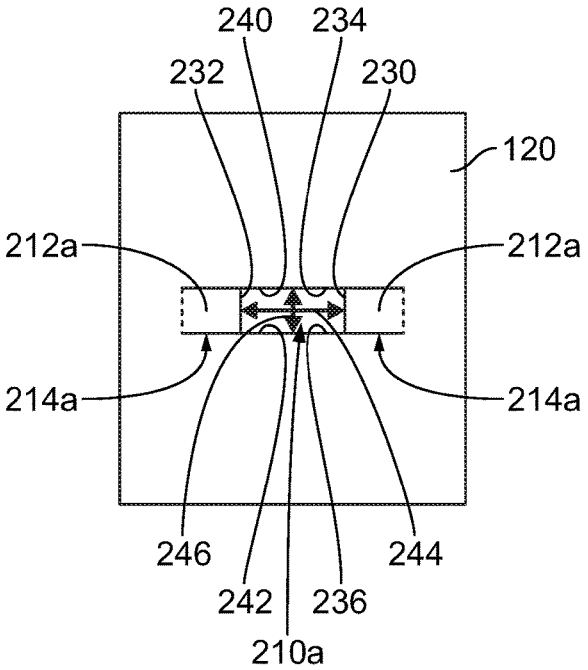
FIG. 6A is a top view of a portion of a conformal pin organizer in accordance with an exemplary embodiment.

FIG. 6A is a top view of a portion of the conformal pin organizer 120 showing one of the signal openings 210*a* in accordance with an exemplary embodiment. The deflecting portions 212*a* are arranged in-line with the signal opening 210*a*. The slits 214*a* are extensions of the signal opening 210*a* and extend parallel to edges of the signal opening 210*a*. The conformal pin organizer 120 includes two deflecting portions 212*a* on opposite sides of the signal opening 210*a* in the illustrated embodiment. One of the deflecting portions 212*a* includes a first engaging surface 230, the other deflecting portion 212*a* includes a second engaging surface 232, a first edge 240 defining the signal opening 210*a* defines a third engaging surface 234, and a second edge 242 defining the signal opening 210*a* defines a fourth engaging surface 236. The first and second engaging surfaces 230, 232 are configured to engage opposite ends of the neck 160 of the signal contact 142 (shown in FIG. 3) and the second and third engaging surfaces 234, 236 are configured to engage opposite sides of the neck 160 of the signal contact 142 such that the engaging surfaces 230, 232, 234, 236 engage all four sides of the neck 160 of the signal contact 142.

In an exemplary embodiment, the signal openings 210 have a longitudinal width 244 and a lateral width 246. The longitudinal width 244 is defined between the first and second engaging surfaces 230, 232 of the deflecting portions 212. The lateral width 246 is defined between the edges 240, 242. In an exemplary embodiment, the longitudinal width 244 is narrower than a longitudinal width of the terminating end 154 at the neck 160 and the lateral width 246 is narrower than a lateral width of the terminating end 154 at the neck 160. As such, the conformal pin organizer 120 is compressed against all four sides of the signal contact 142 for a compression fit. In other various embodiments, the longitudinal width 244 and/or the lateral width 246 may be sized approximately equal to the longitudinal width and/or the lateral width of the terminating end 154 at the neck 164 a clearance or slight interference fit.

Figure 6B:
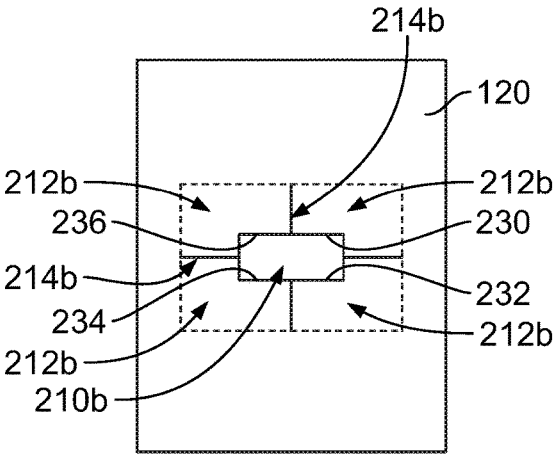
FIG. 6B is a top view of a portion of the conformal pin organizer in accordance with an exemplary embodiment.

FIG. 6B is a top view of a portion of the conformal pin organizer 120 showing one of the signal openings 210*b* in accordance with an exemplary embodiment. The deflecting portions 212*b* are arranged in quadrants defined by the slits 214*b* extending perpendicularly from the signal opening 210*b*. Four deflecting portions 212*b* are provided and the deflecting portions 212*b* are arranged in the corners of the signal opening 210*b*. The deflecting portions 212*b* have engaging surfaces 230, 232, 234, 236 configured to engage all four sides of the neck 160 of the signal contact 142 (shown in FIG. 3).

Figure 6C:
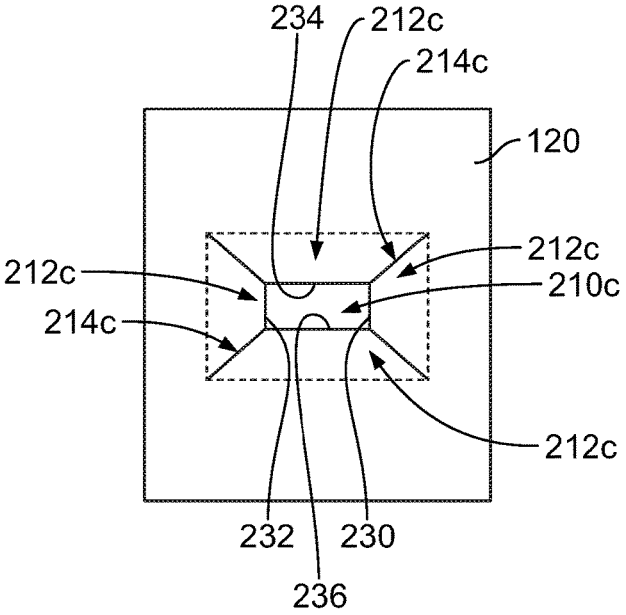
FIG. 6C is a top view of a portion of the conformal pin organizer in accordance with an exemplary embodiment.

FIG. 6C is a top view of a portion of the conformal pin organizer 120 showing one of the signal openings 210*c* in accordance with an exemplary embodiment. The deflecting portions 212*c* are arranged in quadrants defined by the slits 214*c* extending at angles from the four corners of the signal opening 210*c*. Four deflecting portions 212*c* are provided. The deflecting portions 212*c* have engaging surfaces 230, 232, 234, 236 configured to engage all four sides of the neck 160 of the signal contact 142 (shown in FIG. 3).

Figure 7:
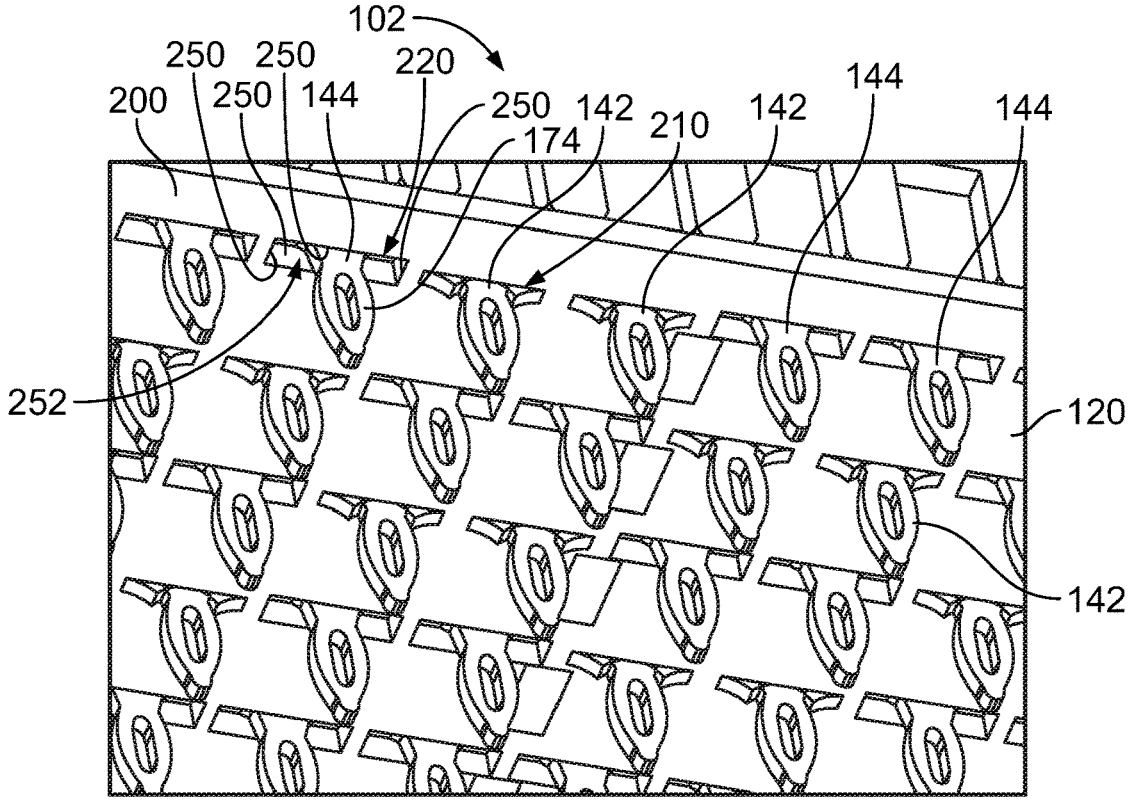
FIG. 7 is a bottom perspective view of a portion of the electrical connector in accordance with an exemplary embodiment.
Figure 8:
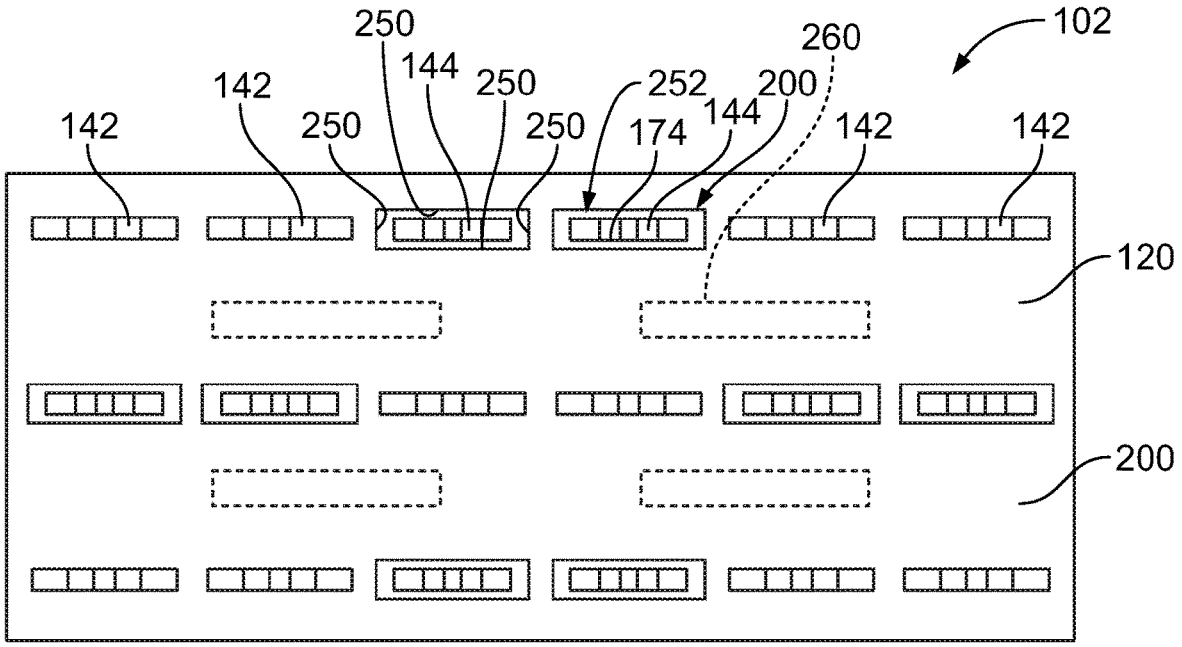
FIG. 8 is a bottom view of a portion of the electrical connector in accordance with an exemplary embodiment.

FIG. 7 is a bottom perspective view of a portion of the electrical connector 102 in accordance with an exemplary embodiment. FIG. 8 is a bottom view of a portion of the electrical connector 102 in accordance with an exemplary embodiment. FIGS. 7 and 8 illustrate the ground openings 220 as being enlarged ground openings without the deflecting portions 222 illustrated in FIG. 2. The ground openings 220 are defined by edges 250 spaced apart from the ground contacts 144. The ground openings 220 form air gaps 252 between the terminating ends 174 of the ground contacts 144 and the conformal pin organizer 120. The air gaps 252 decouple the ground contacts 144 from the conformal pin organizer 120 and introduce air around the ground contacts 144, such as for signal integrity.

In various embodiments, the conformal pin organizer 120 may include shields 260 (shown in phantom in FIG. 8) in the pad 200 spaced apart from the signal openings 210. The shields 260 provide electrical shielding for the signal contacts 142. The shields 260 may be inserted into the pad 200. Alternatively, the shields 260 may be formed with the pad 200. For example, the pads 200 may be molded around the shields 260.

Figure 9:
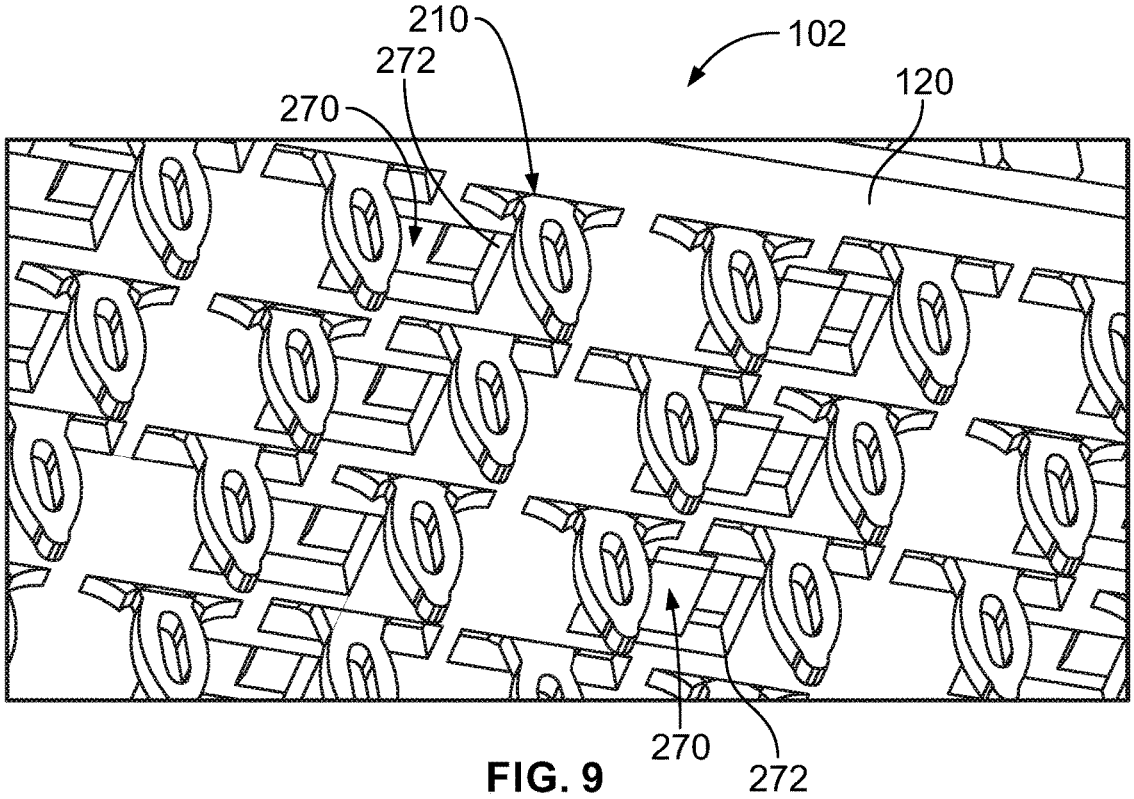
FIG. 9 is a bottom perspective view of a portion of the electrical connector in accordance with an exemplary embodiment.
Figure 10:
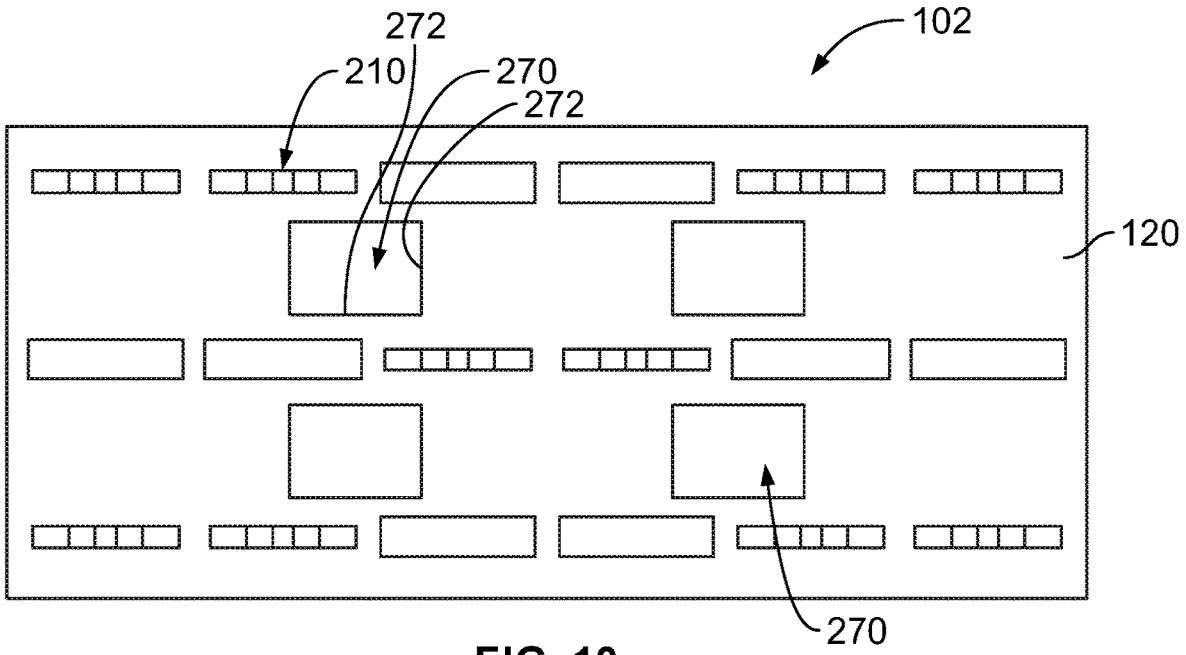
FIG. 10 is a bottom view of a portion of the electrical connector in accordance with an exemplary embodiment.

FIG. 9 is a bottom perspective view of a portion of the electrical connector 102 in accordance with an exemplary embodiment. FIG. 10 is a bottom view of a portion of the electrical connector 102 in accordance with an exemplary embodiment. FIGS. 9 and 10 illustrate the air pockets 270 in the conformal pin organizer 120. The air pockets 270 are defined by edges 272. The air pockets 270 are spaced apart from the signal openings 210. The air pockets 270 introduce air between signal pairs for signal integrity, such as to mitigate crosstalk.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector comprising:

a housing having contact channels, the housing having a mounting end configured to be mounted to a circuit board;

signal contacts received in corresponding contact channels, the signal contacts having mating ends, the signal contacts having terminating ends configured to be terminated to the circuit board, each terminating end having a shoulder, a neck extending from the shoulder and a pin extending from the neck, the neck being narrower than the complaint pin and the shoulder; and a conformal pin organizer coupled to the mounting end of the housing, the conformal pin organizer having signal openings receiving terminating ends of corresponding signal contacts, the conformal pin organizer having deflecting portions extending into the signal openings, the conformal pin organizer positioned along the terminating ends such that the deflecting portions engage the necks of the corresponding terminating ends.

2. The electrical connector of claim 1, wherein the deflecting portions include a fixed ends and free ends, the deflecting portions being flexible at the fixed ends, the free ends engaging the necks.

3. The electrical connector of claim 1, wherein the deflecting portions overlap the pins.

4. The electrical connector of claim 1, wherein each pin is a compliant pin having bulged sections flanking an opening, the compliant pin having a first width at the bulged sections, the signal opening having a second width between the deflecting portions less than the first width, the deflecting portions being deflected outward as the bulged sections pass through the signal opening and returning inward to engage the neck.

5. The electrical connector of claim 1, wherein the conformal pin organizer engages four sides of each terminating end.

6. The electrical connector of claim 1, wherein the conformal pin organizer comprises a rubber material.

7. The electrical connector of claim 1, wherein the conformal pin organizer has a dielectric constant closer to a dielectric constant of the housing than a dielectric constant of the air.

8. The electrical connector of claim 1, wherein the conformal pin organizer is flexible in a mating direction with the circuit board and the housing.

9. The electrical connector of claim 1, wherein the housing includes a mounting feature having a mounting surface configured to engage the circuit board, the conformal pin organizer having a bottom surface coplanar with the mounting surface and configured to engage the circuit board.

10. The electrical connector of claim 1, wherein the deflecting portions are configured to be pressed into the signal openings by the circuit board.

11. The electrical connector of claim 1, further comprising ground contacts received in corresponding contact channels, the ground contacts having terminating ends configured to be terminated to the circuit board, each terminating end having a shoulder, a neck extending from the shoulder and a pin extending from the neck, the neck being narrower than the pin and the shoulder, the conformal pin organizer having ground openings receiving terminating ends of corresponding ground contacts, the conformal pin organizer having second deflecting portions extending into the ground openings, the conformal pin organizer positioned along the terminating ends of the ground contacts such that the second deflecting portions engage the necks of the terminating ends of the corresponding ground contacts.

12. The electrical connector of claim 1, further comprising ground contacts received in corresponding contact channels, the ground contacts having terminating ends configured to be terminated to the circuit board, each terminating end having a pin, the conformal pin organizer having ground openings receiving terminating ends of corresponding ground contacts with the conformal pin organizer spaced apart from the terminating ends of the ground contacts such that air gaps are formed between the terminating ends of the ground contacts and the conformal pin organizer.

13. The electrical connector of claim 1, wherein the conformal pin organizer further comprises air pockets in the conformal pin organizer spaced apart from the signal openings.

14. The electrical connector of claim 1, wherein the conformal pin organizer further comprises shields received in the conformal pin organizer spaced apart from the signal openings, the shields providing electrical shielding for the signal contacts.

15. An electrical connector comprising:

a housing having contact channels, the housing having a mounting end configured to be mounted to a circuit board;

signal contacts received in corresponding contact channels, the signal contacts having mating ends, the signal contacts having terminating ends configured to be terminated to the circuit board, each terminating end having a shoulder, a neck extending from the shoulder and a pin extending from the neck, the neck being narrower than the complaint pin and the shoulder;

ground contacts received in corresponding contact channels, the ground contacts having mating ends, the ground contacts having terminating ends configured to be terminated to the circuit board, each terminating end having a pin; and a conformal pin organizer coupled to the mounting end of the housing, the conformal pin organizer having ground openings receiving terminating ends of corresponding ground contacts with the conformal pin organizer spaced apart from the terminating ends of the ground contacts such that air gaps are formed between the terminating ends of the ground contacts and the conformal pin organizer, the conformal pin organizer having signal openings receiving terminating ends of corresponding signal contacts, the conformal pin organizer having deflecting portions extending into the signal openings, the conformal pin organizer positioned along the terminating ends of the signal contacts such that the deflecting portions engage the necks of the corresponding terminating ends.

16. The electrical connector of claim 15, wherein the deflecting portions are deflected outward as the pin passes through the signal opening and returns inward to engage the neck.

17. The electrical connector of claim 15, wherein the conformal pin organizer engages four sides of each terminating end.

18. An electrical connector assembly comprising:

a circuit board having a mounting surface, the circuit board having signal vias and ground vias; and an electrical connector mounted to the mounting surface, the electrical connector comprising:

a housing having a mounting end mounted to the mounting surface of the circuit board, the housing having contact channels;

signal contacts received in corresponding contact channels, the signal contacts having mating ends, the signal contacts having terminating ends terminated to the circuit board, each terminating end having a shoulder, a neck extending from the shoulder and a compliant pin extending from the neck, the compliant pin being press fit in the corresponding signal via of the circuit board, the neck being narrower than the complaint pin and the shoulder;

ground contacts received in corresponding contact channels, the ground contacts having mating ends, the ground contacts having terminating ends terminated to the circuit board, each terminating end having a compliant pin press fit in the corresponding ground via of the circuit board; and a conformal pin organizer positioned between the mounting end of the housing and the mounting surface of the circuit board, the conformal pin organizer having ground openings receiving terminating ends of corresponding ground contacts, the conformal pin organizer having signal openings receiving terminating ends of corresponding signal contacts, the conformal pin organizer having deflecting portions extending into the signal openings, the conformal pin organizer positioned along the terminating ends of the signal contacts such that the deflecting portions engage the necks of the corresponding terminating ends.

19. The electrical connector assembly of claim 18, wherein the terminating end of each ground contact has a shoulder, a neck extending from the shoulder and a compliant pin extending from the neck, the neck being narrower than the compliant pin and the shoulder, the conformal pin organizer having second deflecting portions extending into the ground openings, the conformal pin organizer positioned along the terminating ends of the ground contacts such that the second deflecting portions engage the necks of the terminating ends of the corresponding ground contacts.

20. The electrical connector assembly of claim 19, wherein the conformal pin organizer is positioned with the conformal pin organizer spaced apart from the terminating ends of the ground contacts such that air gaps are formed between the terminating ends of the ground contacts and the conformal pin organizer.

* * * * *